US006599222B2

(12) United States Patent
Wince

(10) Patent No.: US 6,599,222 B2
(45) Date of Patent: Jul. 29, 2003

(54) ENCAPSULATED WEIGHT SYSTEM

(76) Inventor: Kevin Wince, 3004 Antler Trail, Marietta, GA (US) 30066

( * ) Notice: Subject to any disclaimer, the term of this patent is extended or adjusted under 35 U.S.C. 154(b) by 0 days.

(21) Appl. No.: 10/027,110

(22) Filed: Dec. 20, 2001

(65) Prior Publication Data

US 2002/0091045 A1 Jul. 11, 2002

Related U.S. Application Data

(60) Provisional application No. 60/257,555, filed on Dec. 22, 2000.

(51) Int. Cl.[7] ..... A63B 21/072
(52) U.S. Cl. ..... 482/106; 482/93; 482/108
(58) Field of Search ..... 482/44, 93, 106–109

(56) References Cited

U.S. PATENT DOCUMENTS

| | | | | | |
|---|---|---|---|---|---|
| 3,758,109 | A | * | 9/1973 | Bender | 482/93 |
| 4,743,016 | A | * | 5/1988 | Van Derworp et al. | 482/93 |
| 5,312,314 | A | * | 5/1994 | Stephan et al. | 482/106 |
| 5,328,431 | A | * | 7/1994 | Winslow | 482/106 |
| 5,496,244 | A | * | 3/1996 | Caruthers | 482/108 |
| 5,653,664 | A | * | 8/1997 | Jennings | 482/93 |

FOREIGN PATENT DOCUMENTS

| | | | | | |
|---|---|---|---|---|---|
| DE | 4328251 | A1 | * | 9/1994 | 482/106 |
| SU | 1674868 | A1 | * | 9/1991 | 482/107 |
| SU | 1766430 | A1 | * | 10/1992 | 482/107 |
| WO | 93/09850 | A1 | * | 5/1993 | 482/108 |

* cited by examiner

*Primary Examiner*—Nicholas D. Lucchesi
*Assistant Examiner*—Victor Hwang
(74) *Attorney, Agent, or Firm*—James W. Kayden; Thomas, Kayden, Horstemeyer & Risley, LLP

(57) ABSTRACT

An encapsulated weight system for resistance training comprising a first dumbbell having a center portion with a borehole disposed axially therein forming an interior load area. The first dumbbell further comprises a first end cap and a second end cap, wherein the first end cap and the second end cap are arranged and configured to releasably engage opposing ends of the center portion, thereby covering the interior load area. At least one weight capsule is arranged and configured to substantially correspond to at least a portion of the interior load area. The weight capsule can be alternately added and removed from the interior load area of the first dumbbell to alternately increase and decrease weight of said first dumbbell.

8 Claims, 3 Drawing Sheets

ENCAPSULATED WEIGHT SYSTEM

CROSS-REFERENCE TO RELATED APPLICATION

This application claims priority to copending U.S. provisional application entitled, "Encapsulated Weight Set," having serial No. 60/257,555, filed Dec. 22, 2000, which is entirely incorporated herein by reference.

TECHNICAL FIELD

The present invention is generally related to resistance weight training systems and apparatus and, more particularly, is related to an encapsulated weight system.

BACKGROUND OF THE INVENTION

Working out, such as engaging in cardiovascular exercise and resistance weight training, is increasing in popularity and is a common way for people to maintain physical health and well being. Gymnasium facilities and health clubs provide access to various apparatus, such as treadmills, stationary bicycles, and free weight sets, to readily facilitate such exercise. Gym facilities, however, are not always either accessible or desirable to an individual wishing to engage in such exercise activities. Furthermore, gyms often require memberships that can be expensive and limited to particular locations, which can make them less desirable. While one can readily engage in cardiovascular exercise without a gym, through, for example, running, biking, or rowing outdoors, resistance weight training without the use of the apparatus commonly available at a gym, such as free weights, can be more difficult.

In particular, proper resistance weight training requires a variety of weighted apparatus, each in a range of weights for training various muscle groups. For example, although a shorter, dumbbell-type weight may be used to train both the biceps, triceps and shoulder muscles, each muscle group may require a different weight for appropriate training. Furthermore, during the same training session, one may desire to train a muscle group requiring a longer barbell-type weight, thereby requiring yet a different configuration of training apparatus as well as a different amount of weight. Traditional weights typically available at a gym and for home use consist of a bar having weighted members placed at opposing ends of the bar. This conventional configuration distributes stress somewhat unevenly to muscles.

Where one desires to engage in resistance weight training at home, the individual needs to acquire a variety of weight configurations as well as a variety of weight amounts for each configuration, in order to train properly. This can be both expensive as well as space consuming in the home. Traveling also introduces a challenge to consistent weight training. It is often expensive to pay for a one time visit to a gym that typically requires membership, and sometimes is even not allowed by the facility. Furthermore, traveling with a variety of weight configurations as well as the varying weight amounts is difficult and hotel gymnasium facilities are often deficient.

Thus, a heretofore unaddressed need exists in the industry to address the aforementioned deficiencies and inadequacies.

SUMMARY OF THE INVENTION

An encapsulated weight system for resistance training comprises a first dumbbell having a center portion with a borehole disposed axially therein. The borehole forms an interior load area defined by a length and a diameter. The first dumbbell further comprises a first end cap and a second end cap, wherein the first end cap and the second end cap are arranged and configured to releasably engage opposing ends of the center portion, thereby covering the end of the interior load area. A plurality of weight capsules are provided and substantially correspond to the diameter of the interior load area and to at least a portion of the length of the interior load area. At least one of the plurality of weight capsules can be alternately added to and removed from the interior load area of the first dumbbell to alternately increase and decrease the weight of the first dumbbell.

In another embodiment, the encapsulated weight system of the present invention comprises a pair of dumbbells and a barbell adapter. The barbell adapter is arranged and configured to releasably receive on opposing ends thereof a center portion of each of the dumbbells to form a substantially elongated barbell. Where center portions of the pair of dumbbells are not releasably fixed on opposing ends of the barbell adapter, the system can be configured as a pair of dumbbells.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF A PREFERRED EMBODIMENT

Figure 1:
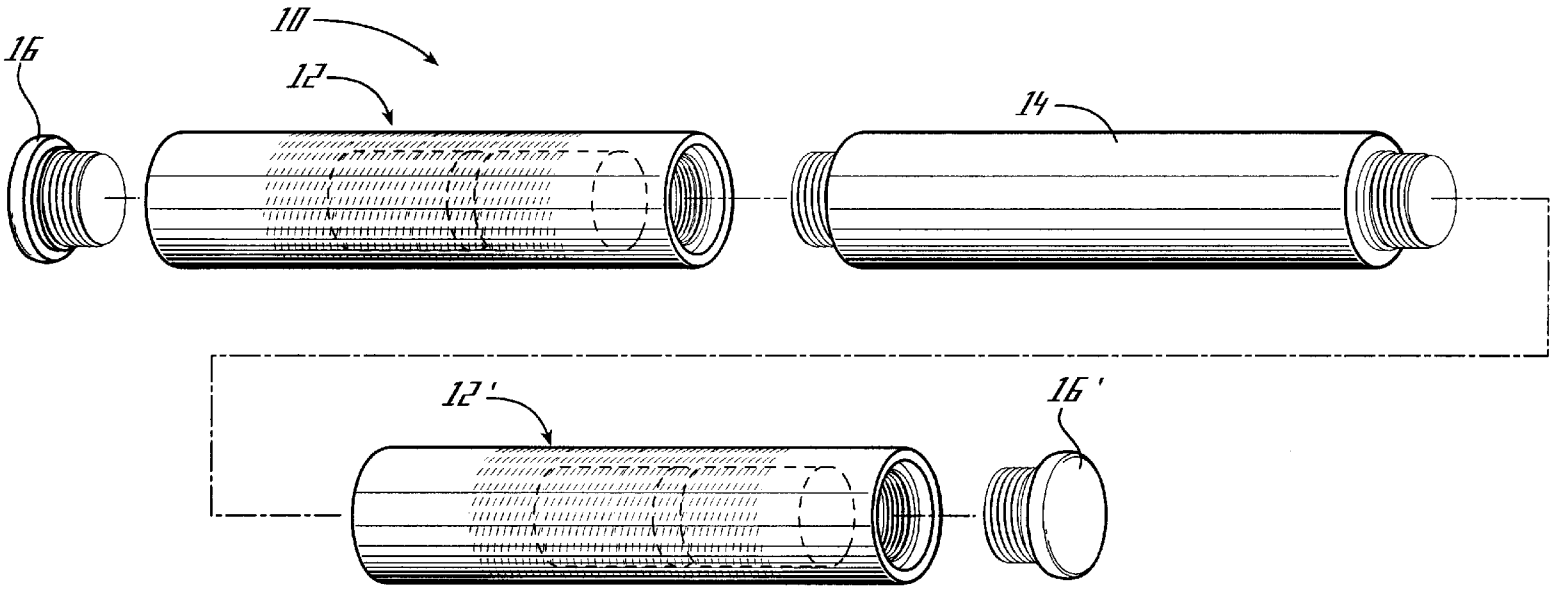
FIG. 1 illustrates an exploded side perspective view of an encapsulated weight system of the present invention in a barbell configuration.
Figure 2:
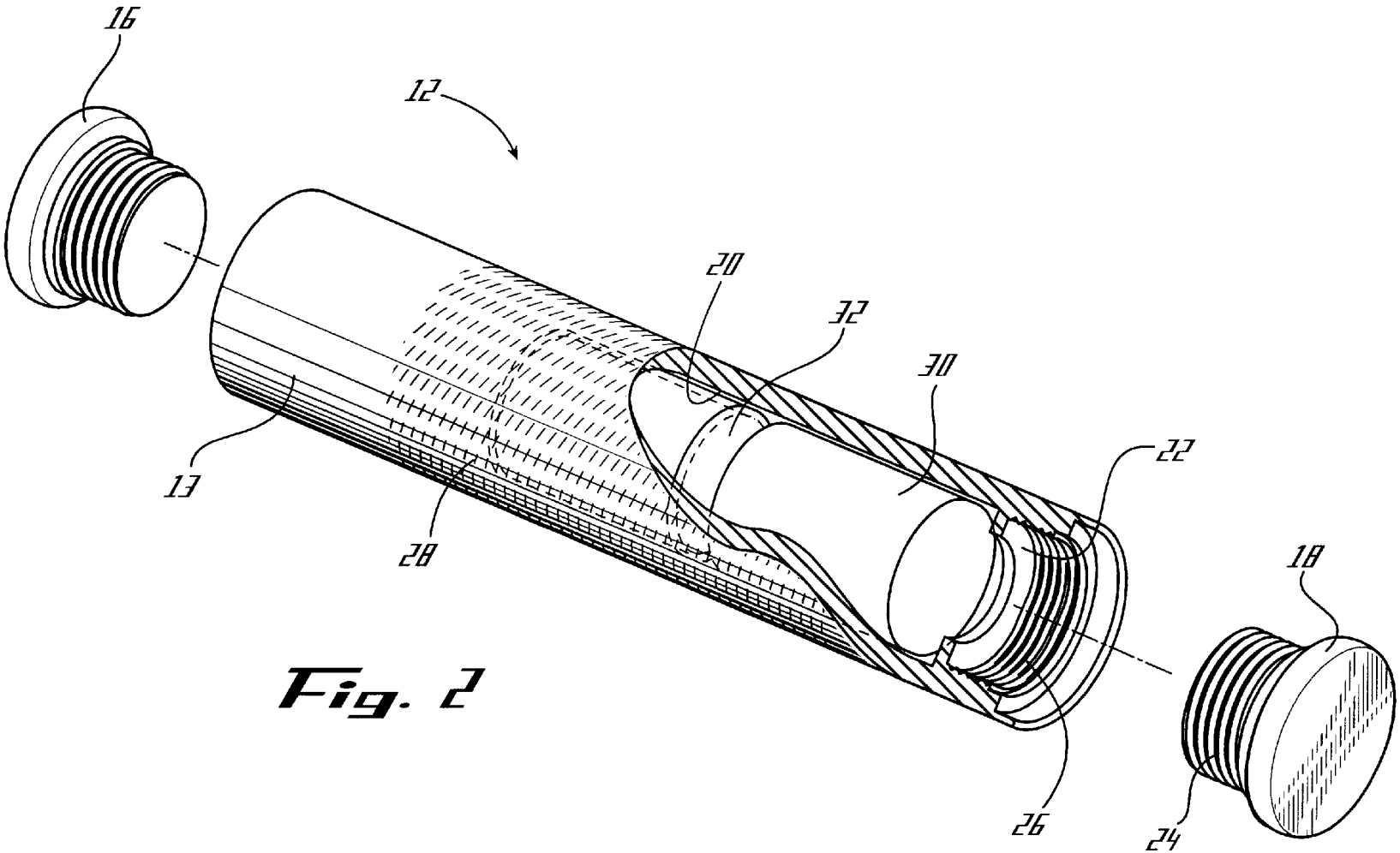
FIG. 2 illustrates a cut-away side perspective view of an embodiment of a first dumbbell comprising a portion of the encapsulated weight system illustrated in FIG. 1.

An embodiment of the encapsulated weight system 10 is illustrated in FIG. 1. The system 10 comprises a first dumbbell 12, a second dumbbell 12', and a barbell adapter 14. The encapsulated weight system 10 can be arranged and configured as a barbell upon fixing portions of the first dumbbell 12 and the second dumbbell 12' to opposing ends of the barbell adapter 14 thereby forming a substantially elongated bar. A free end of the first dumbbell 12 can be capped with a first end cap 16 and the free end of the second dumbbell 12' can similarly be capped by a first end cap 16'. The components of the encapsulated weight system 10 can comprise any suitable material, such as metal, plastic, hard rubber, or the like. It is preferable, however, that the components themselves are somewhat heavy thereby adding to the effectiveness of the system 10 as a weight training device. The encapsulated weight system 10 can also be arranged and configured to form at least one dumbbell 12 (FIG. 2). The system 10 also comprises a weight capsule 30 and a spacer capsule 32.

Figure 2A:
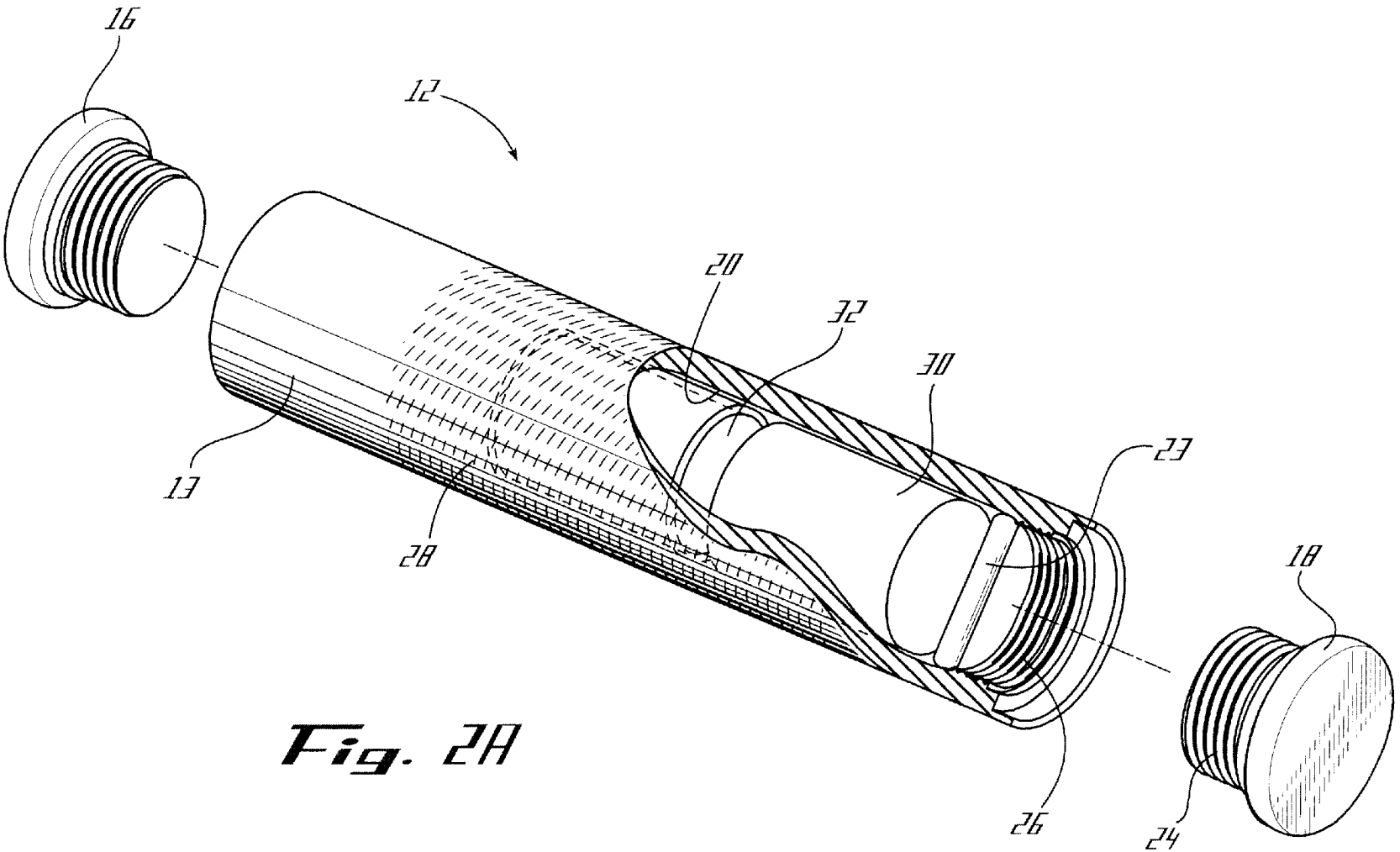
FIG. 2A illustrates a cut-away side perspective view of an embodiment of a first dumbbell comprising a portion of the encapsulated weight system illustrated in FIG. 1.

FIG. 2 illustrates the first dumbbell 12 in greater detail and the encapsulated weight system 10 as arranged in a dumbbell configuration. Although the first dumbbell 12 will be described herein in detail, it should be understood that the second dumbbell 12' comprises substantially similar features and elements as the first dumbbell 12. The first dumbbell 12 comprises a substantially cylindrical center portion 13 having a borehole disposed substantially axially therein and forming an interior load area 20. The dumbbell 12 optionally comprises a stop 22 disposed toward an end of the center portion 13 and arranged and configured to interrupt the diameter of the interior load area 20. The stop 22 can comprise a ridge or ring extending inwardly in the interior load area 20 thereby decreasing the diameter of the interior load area 20, as illustrated in FIGS. 2 and 2A, a pin 23 extending the diameter of the interior load area 20, a tapering of the diameter of the interior load area 20 or any suitable member or configuration effective to prevent an article substantially corresponding to the diameter of the interior load area 20 from passing beyond the stop 22.

Dumbbell 12 further comprises a first end cap 16 and a second end cap 18 arranged and configured to releasably engage opposing ends of the center portion 13 and cover opposing ends of the interior load area 20. In one configuration, each of the first end cap 16 and the second end cap 18 comprise a threaded member 24 extending therefrom and substantially corresponding to the diameter of the interior load area 20. The interior load area 20 comprises an interior threaded portion 26 toward each of the opposing ends thereof. It is preferred that the threaded member 24 is arranged and configured to engage the threaded portion 26 disposed in the interior load area 20. The first end cap 16 and the second end cap 18 can also comprise a snap fit member, or any suitable member. The dumbbell 12 can comprise a grip 28 disposed around the exterior of the center portion 13. The grip 28 can comprise a wrap of any suitable material, such as rubber or the like, a textured or knurled area formed in the material of the center portion 13 itself (as shown), or any suitable means to assist a user in maintaining a strong, steady hold of the dumbbell 12. It is preferable that the grip 28 includes a substantial area to assist in relieving stress applied to relatively small bones in the palm of a user's hand. It should be noted that the grip 28 also assists a user in maintaining a solid grip of the system 10 as disposed in a barbell configuration.

The encapsulated weight system 10 of the present invention also comprises at least one weight capsule 30 and at least one spacer capsule 32. Both the weight capsule 30 and the spacer capsule 32 preferably substantially corresponds to the diameter of the interior load area 20 and can be easily inserted and removed into the interior load area 20 through an opening in the end of the center portion 13 corresponding to the first end cap 16. It is preferable that the encapsulated weight system 10 includes a plurality of weight capsules 30 as well as a plurality of spacer capsules 32. As such, the weight of the center portion 13 can be altered between a range of weights as a function of the number and combination of weight capsules 30 and spacer capsules 32 disposed in the interior load area 20. A user traveling with the system 10 need only travel with the weight capsules 30 and/or spacer capsules 32 needed.

The weight capsules 30 can comprise any suitable weight and can be solid or hollow. Similarly, the spacer capsules 32 can comprise any suitable weight, but are preferably lighter in weight than the weight capsules 30. Spacer capsules 32 can be, for example, hollow enclosed capsules (FIG. 2), hollow tubes (FIG. 2A) or cubes, or light weight solid members. Furthermore, the capsules 30, 32 can comprise any suitable material, such as, for example, metal, plastic, a combination thereof, or the like. In use, any combination of the weight capsules 30 and spacer capsules 32 can be disposed within the interior load area 20 of the first dumbbell 12 and/or the second dumbbell 12'. IN another embodiment the barbell adapter 14 can be arranged and configured to receive weight capsules 30, spacer capsules 32, or any combination thereof.

In a dumbbell configuration, the desired combination of weight capsules 30 and spacer capsules 32 are disposed within the interior load area 20 of the dumbbell 12. The first end cap 16 is disposed on the end of the center portion 13 opposing the stop 22. The capsules 30, 32 are pinned between the optional stop 22 and the threaded portion 24 of the first end cap 16. The second end cap 18 is placed on the center portion 13 to balance the dumbbell 12. Where the stop 22 is not included, the capsules 30, 32 disposed within the interior load area 20 of the dumbbell 12 are pinned between the threaded portion 24 of the first end cap 16 and the threaded portion 24 of the second end cap 18. The second dumbbell 12' can be assembled in a similar manner.

In a barbell configuration, the center portion 13 of the first barbell 12 is removably attached to one end of the barbell adapter 14. The center portion 13 of the second barbell 12' is removably fixed to the opposing end of the barbell adapter 14. The desired combination of weight capsules 30 and spacer capsules 32 are disposed within the interior load area 20 of the center portion 13 of both the first barbell 12 and the second barbell 12'. Where a stop 22 is included in the center portion 13 of the dumbbell 12, 12', it is preferable that the barbell adapter 14 is fixed to the center portion 13 of the first dumbbell 12 and the second dumbbell 12' at the end toward the stop 22. The first end cap 16 is removably fixed to the center portion 13 of the first dumbbell 12 and the center portion 13 of the second dumbbell 12' to balance the barbell. The capsules 30, 32 are slidably pinned between the stop 22 and the threaded member 24 of the first end cap 16 of both the first barbell 12 and the second barbell 12'. Where the stop 22 is not included, the capsules 30, 32 are slidably pinned between the threaded member 34 of the barbell adapter 14 and the threaded member 24 of the first end cap 16 of each of the first dumbbell 12 and the second dumbbell 12'.

Figure 3:
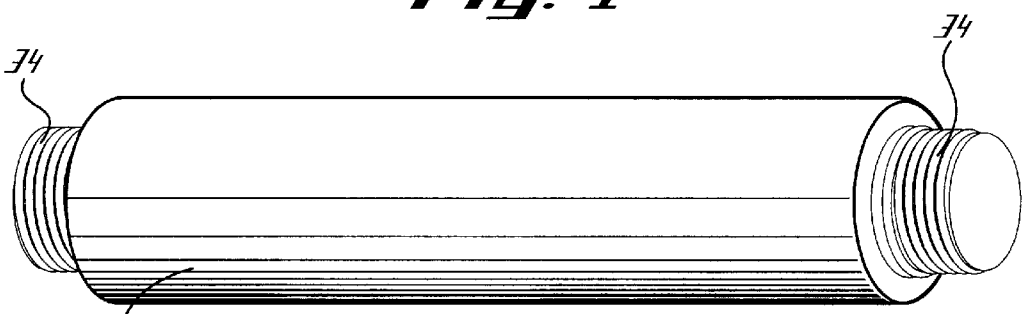
FIG. 3 illustrates a side perspective view of a barbell adapter comprising a portion of the encapsulated weight system illustrated in FIG. 1.

As discussed previously, the first dumbbell 12 and the second dumbbell 12' can be releasably fixed to a barbell adapter 14 (FIG. 3) to form a barbell. The tri-bar design provides for a barbell that consumes relatively little storage space. The barbell adapter 14 comprises a threaded member 34 protruding from opposing ends of the barbell adapter 14. The threaded member 34 is arranged and configured to engage the threaded portion 26 disposed in the interior load area 20 of the first dumbbell 12 and the second dumbbell 12'. The first dumbbell 12 and the second dumbbell 12' can be releasably fixed to the barbell adapter 14 at opposing ends thereof upon engaging the threaded member 34 of the barbell adapter 14 with the threaded portion 26 of the first dumbbell 12 and the second dumbbell 12'. It is preferable that the dumbbell 12 engages the threaded member 34 of the barbell adapter 14 toward the stop 22 disposed in the dumbbell 12. In this configuration, the desired combination of weight capsules 30 and spacer capsules 32 are disposed in the interior load area 20 of the first dumbbell 12 and the second dumbbell 12'.

The combination of capsules 30, 32 in each of the first dumbbell 12 and the second dumbbell 12' is the same, such as to evenly weight the barbell. The optional stop 22 contributes to evenly loading the first dumbbell 12 and the second dumbbell 12' by leading the user to load the capsules 30, 32 into the interior load area 20 of the dumbbells 12, 12' from the same end with respect to attachment of the barbell adapter 14. The barbell adapter 14 can be solid, hollow, or partially hollow and can comprise any suitable material and weight. The barbell adapter 14 can also be arranged and configured to receive a weight capsule 30, a spacer capsule 32 or any combination thereof.

It should be noted that the center portion 13, first end cap 16, second end cap 18, and barbell adapter 14 can alone comprise any desired weight easily alterable with the inclusion of weight capsules 30 and/or a combination of weight capsules 30 and spacer capsules 32 disposed within the interior load area 20 of the dumbbell 12.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. An encapsulated weight system for resistance training, comprising:

a first dumbbell comprising a center portion having a borehole disposed axially therein forming an interior load area being defined by a length and a diameter, said first dumbbell having a first end cap and a second end cap, wherein said first end cap and said second end cap are arranged and configured to releasably engage opposing ends of said center portion, thereby covering said interior load area;

a stop comprising a substantially rigid member extending radially inwardly within said interior load area, said stop being disposed toward one of said opposing ends;

at least one weight capsule being arranged and configured to substantially correspond to said diameter of said interior load area of said first dumbbell; and at least one spacer capsule being arranged and configured to substantially correspond to said diameter of said interior load area of said first dumbbell, said spacer capsule weighing less than said weight capsule;

wherein at least one of said weight capsule and said spacer capsule can be disposed in said interior load area of said first dumbbell such that said capsule fills the interior load area between said stop and one of said first end cap and said second end cap disposed opposing said stop.

2. The encapsulated weight system of claim 1, further comprising:

a second dumbbell comprising a center portion having a borehole disposed axially therein forming an interior load area being defined by a length and a diameter, said second dumbbell having a first end cap and a second end cap, said first end cap and said second end cap being arranged and configured to releasably engage opposing ends of said center portion thereby covering said interior load area; and a stop comprising a substantially rigid member extending radially inwardly within said interior load area, said stop being disposed toward one of said opposing ends;

wherein at least one of said weight capsule and said spacer capsule can be disposed in said interior load area of said second dumbbell such that said capsule fills the interior load area between said stop and one of said first end cap and said second end cap disposed opposing said stop.

3. The encapsulated weight system of 2, further comprising:

a barbell adapter being arranged and configured to releasably receive said first dumbbell and said second dumbbell at opposing ends of said barbell adapter such that said stop of said first dumbbell and said stop of said second dumbbell are disposed toward said barbell adapter.

4. The encapsulated weight system of claim 2, wherein said stop comprises:

a ring disposed around said diameter of said interior load area and extending inwardly in said interior load area.

5. The encapsulated weight system of claim 2, wherein said stop comprises:

a pin extending across said diameter of said interior load area.

6. An encapsulated weight system for resistance training, comprising:

a first dumbbell comprising a center portion having opposing ends and a borehole disposed axially therein forming an interior load area defined by a length and a diameter, said first dumbbell having a first end cap and a second end cap, each being adapted to releasably engage one of said opposing ends of said center portion;

a stop comprising a substantially rigid member extending radially inwardly within said interior load area of said first dumbbell, said stop being disposed toward one of said opposing ends;

a second dumbbell comprising a center portion having opposing ends and a borehole disposed axially therein forming an interior load area defined by a length and a diameter, said second dumbbell having a first end cap and a second end cap, each being adapted to releasably engage one of said opposing ends of said center portion;

a stop comprising a substantially rigid member extending radially inwardly within said interior load area of said second dumbbell, said stop being disposed toward one of said opposing ends;

a barbell adapter being arranged and configured to releasably receive said first dumbbell and said second dumbbell at opposing ends of said barbell adapter;

a plurality of weight capsules, each of said plurality of weight capsules being arranged and configured to be disposed within said interior load area of said first dumbbell and said second dumbbell; and a plurality of spacer capsules, each of said spacer capsules being arranged and configured to be disposed within said interior load area of said first dumbbell and said second dumbbell;

wherein said first dumbbell is releasably fixed to an end of said barbell adapter such that said stop of said first dumbbell is disposed toward said barbell adapter and said second dumbbell is releasably fixed to an opposing end of said barbell adapter such that said stop of said second dumbbell is disposed toward said barbell adapter and said first end caps are removably disposed one each on said first dumbbell and said second dumbbell each opposing said barbell adapter and a combination of said capsules is disposed in each of said first dumbbell and said second dumbbell between said stop and said first end cap.

7. The encapsulated weight system of claim 6, wherein said stop comprises:

a ring disposed around said diameter of said interior load area and extending inwardly in said interior load area.

8. The encapsulated weight system of claim 6, wherein said stop comprises:

a pin extending across said diameter of said interior load area.

* * * * *